US008250845B2

(12) United States Patent
Kimura et al.

(10) Patent No.: US 8,250,845 B2
(45) Date of Patent: Aug. 28, 2012

(54) FIBER COMPOSITE TWISTED CABLE

(75) Inventors: Hiroshi Kimura, Tokyo (JP); Tsuyoshi Enomoto, Tokyo (JP)

(73) Assignee: Tokyo Rope Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 12/946,282

(22) Filed: Nov. 15, 2010

(65) Prior Publication Data

US 2011/0192132 A1 Aug. 11, 2011

(30) Foreign Application Priority Data

Feb. 9, 2010 (JP) ..... 2010-000773 U

(51) Int. Cl.
*D02G 3/48* (2006.01)

(52) U.S. Cl. ..... 57/241

(58) Field of Classification Search ..... 57/236, 57/241

See application file for complete search history.

(56) References Cited

U.S. PATENT DOCUMENTS 4,978,360 A * 12/1990 Devanathan ..... 264/136
5,060,466 A * 10/1991 Matsuda et al. ..... 57/7

FOREIGN PATENT DOCUMENTS

JP 2-127583 5/1990

* cited by examiner

*Primary Examiner* — Shaun R Hurley
(74) *Attorney, Agent, or Firm* — Michael J. Striker

(57) ABSTRACT

The invention relates to a composite twisted cable formed by impregnating carbon fibers with thermoplastic resin, and provides a fiber composite twisted cable which allows downsizing of a reel by being easy to be bent, can be transported to mountain areas which is normally hard to achieve a transport with a large vehicle, is hard to be curled, and is superior in workability. It is a cable having 1×n structure which is formed by impregnating bundles of carbon fibers with thermosetting resin, then twisting a plurality of strands each formed by covering an outer periphery of the bundle with a fiber, and then curing the thermosetting resin by applying the heat treatment, and a core strand and side strands which constitute the cable are separated and independent without being bonded so as to allow independent behavior of the respective strands when the cable is bent.

5 Claims, 10 Drawing Sheets

FIG. 1-A
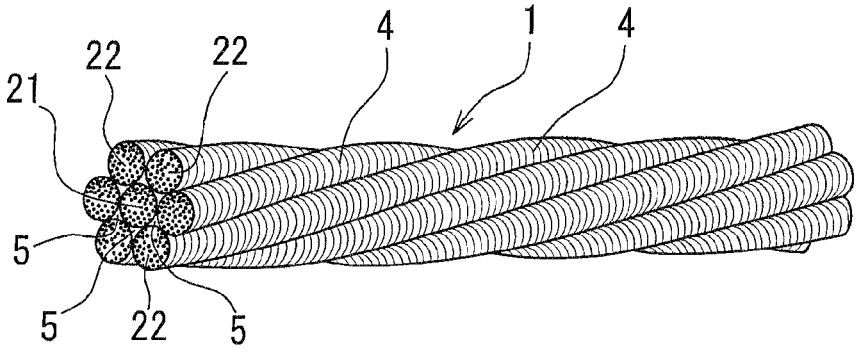
FIG. 1-B
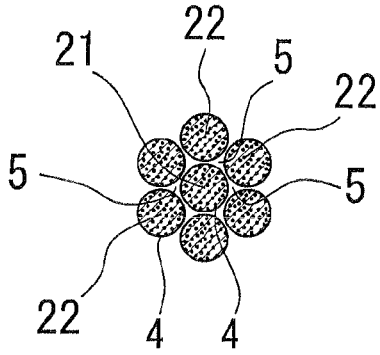
FIG. 1-C
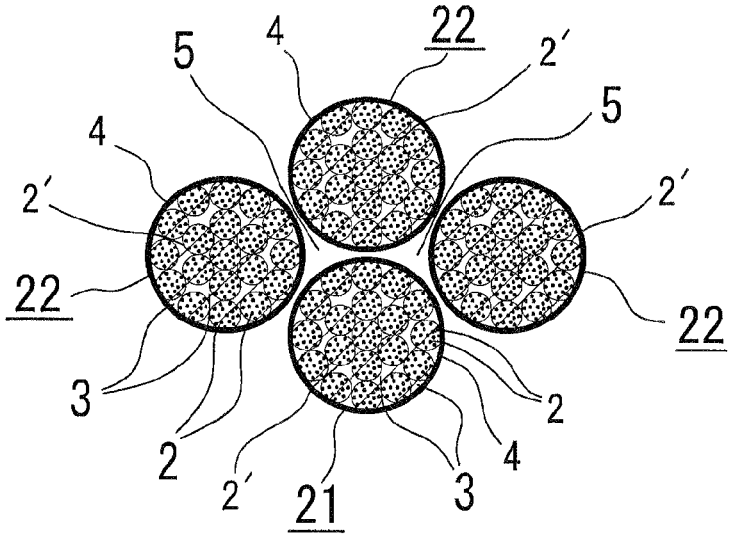

FIG. 2-A
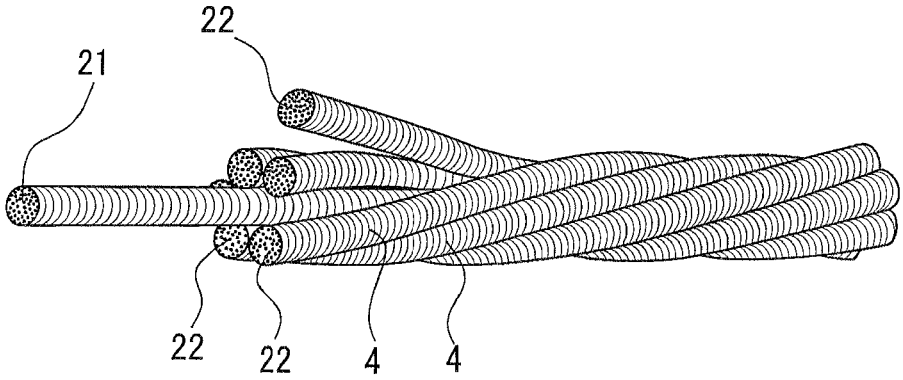
FIG. 2-B
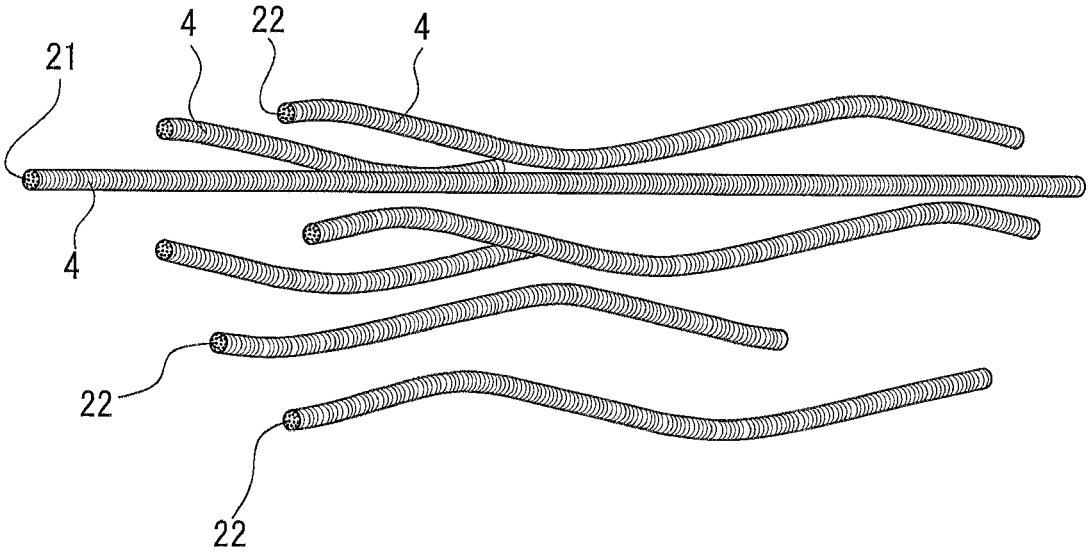

FIG. 7-A
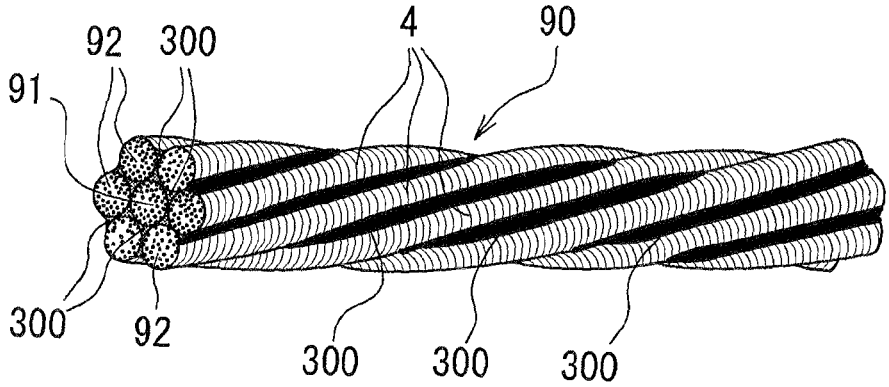
FIG. 7-B
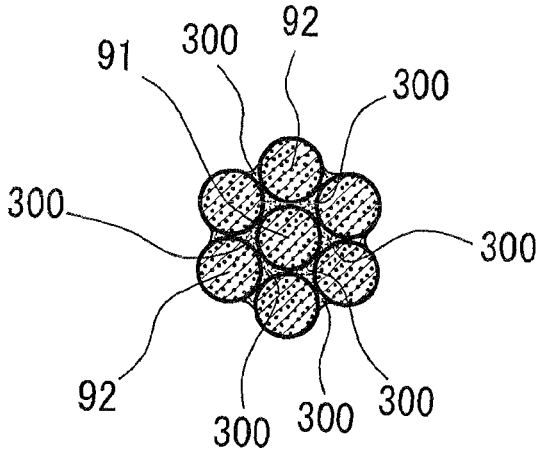
FIG. 7-C
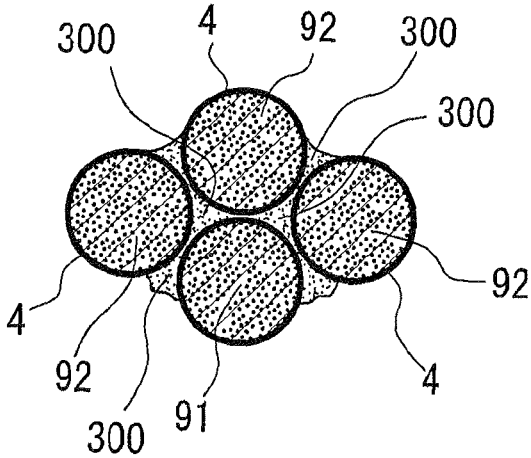

FIG. 8-A
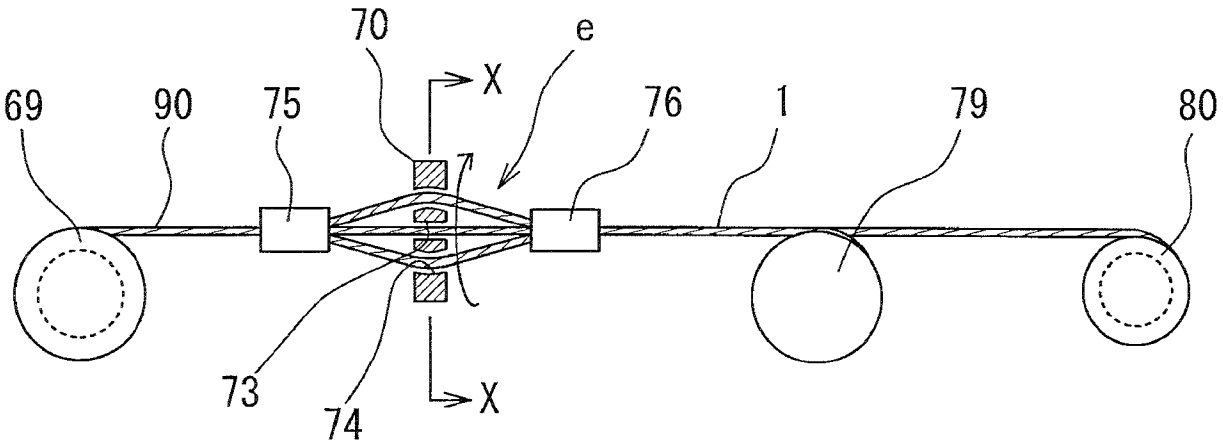
FIG. 8- B
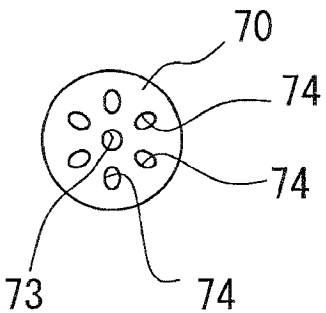

FIG. 9-A
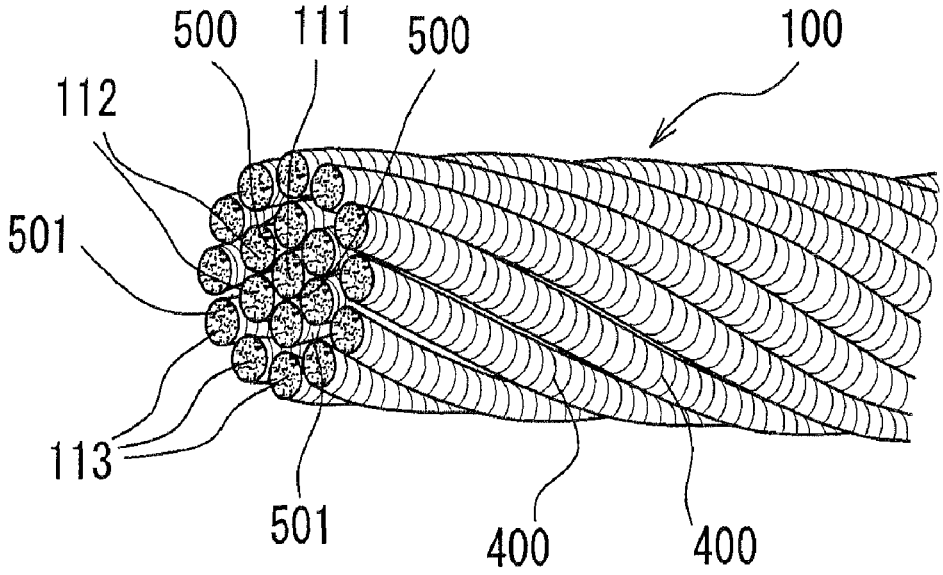
FIG. 9-B
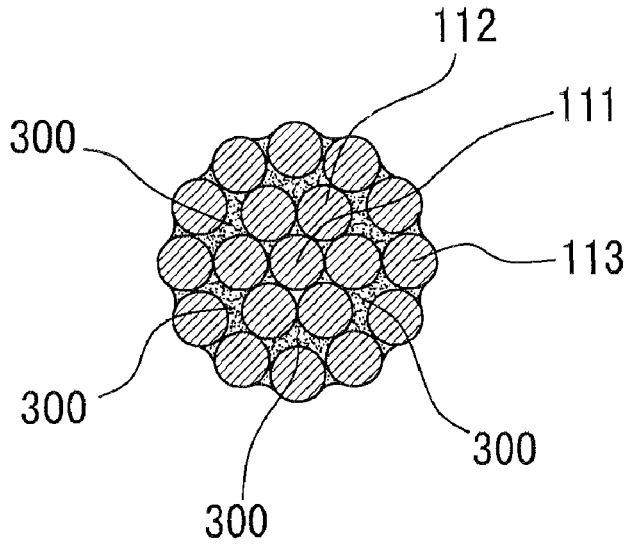

FIG. 10-A
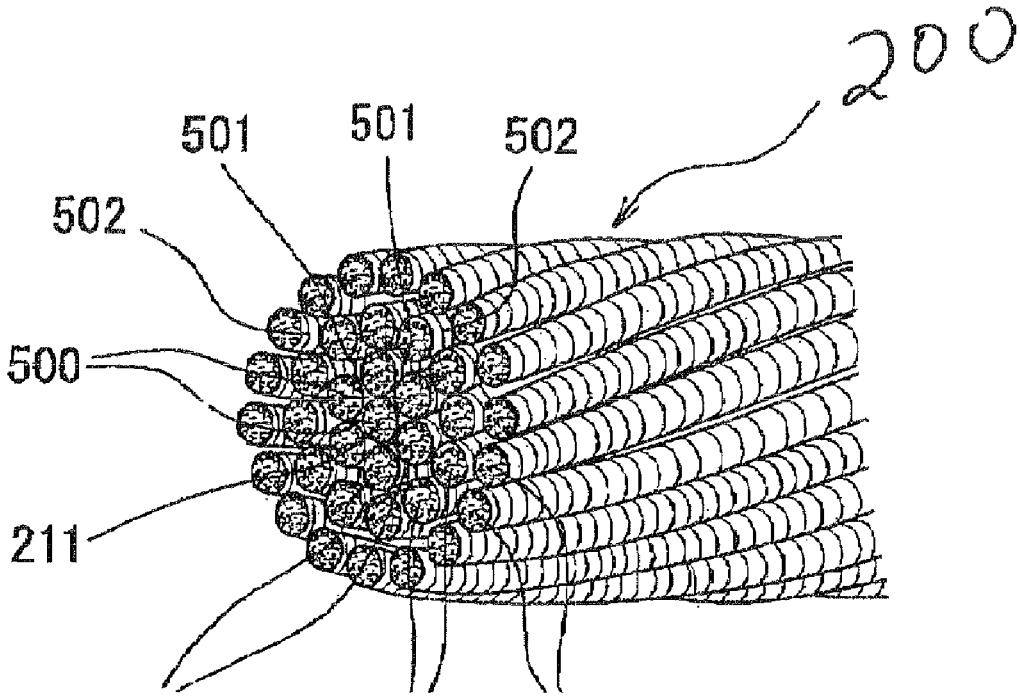
FIG. 10-B
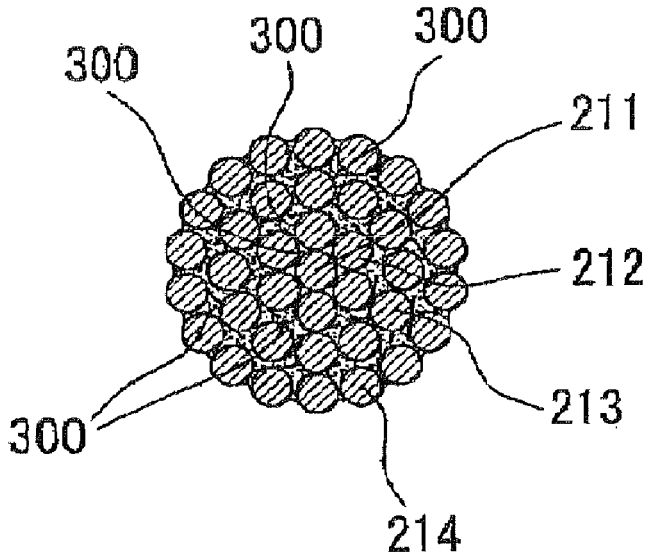

FIG. 11-A
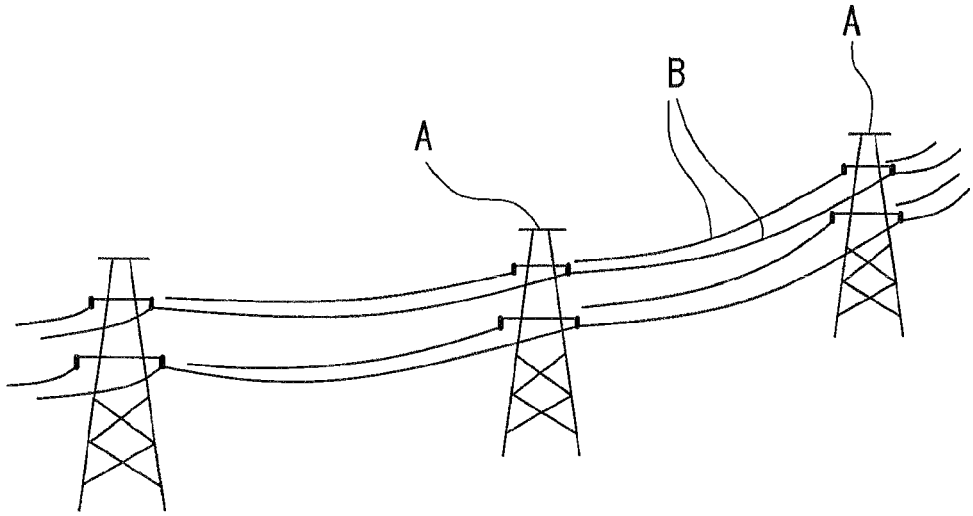
FIG. 11-B
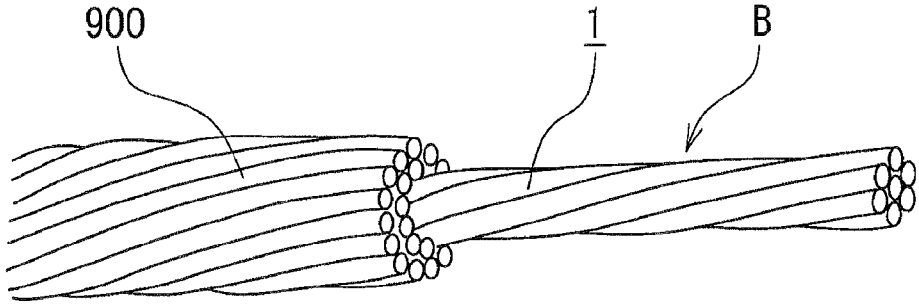
FIG. 11-C
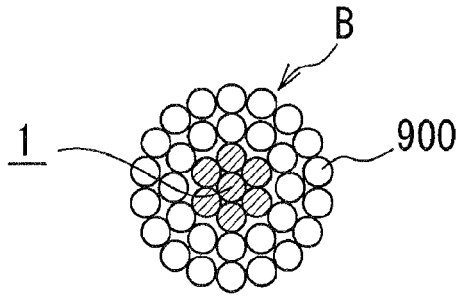

FIG. 12-A
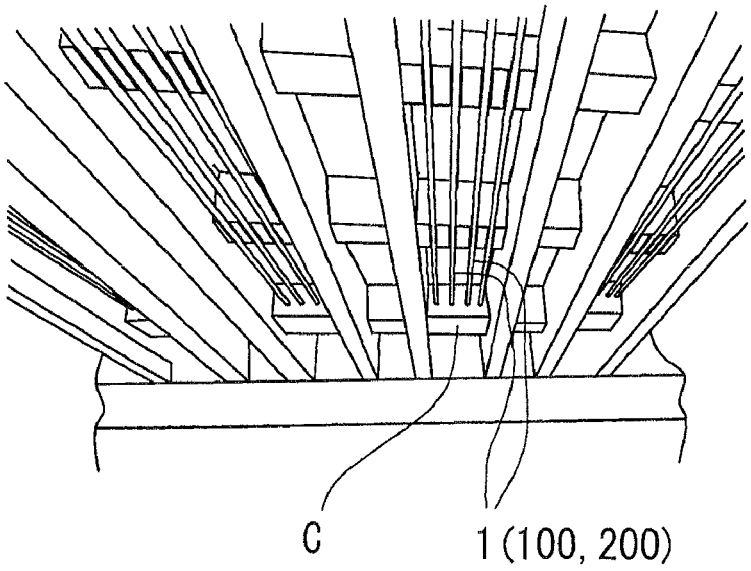
FIG. 12-B
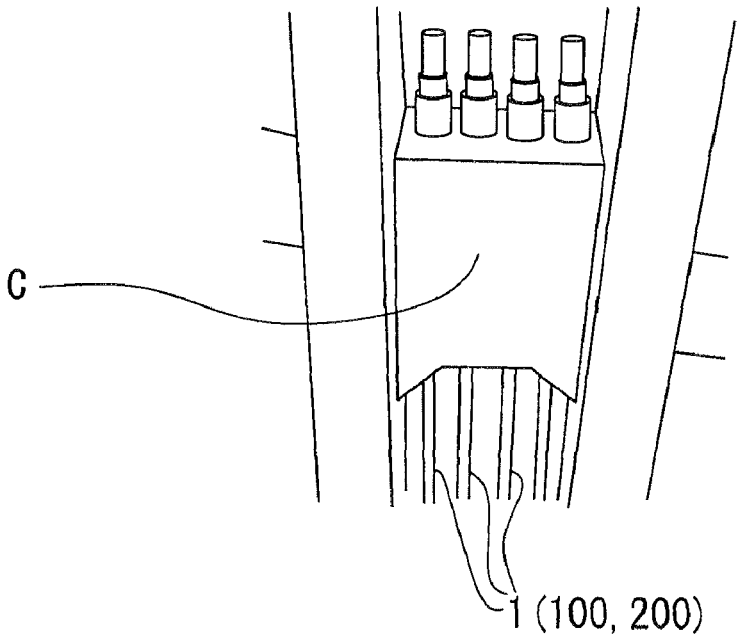

FIBER COMPOSITE TWISTED CABLE

BACKGROUND OF THE INVENTION

1. Technical Field

The present invention relates to a fiber composite twisted cable and, more specifically, to a twisted cable in which carbon fibers and thermosetting resin as a matrix are combined.

2. Description of the Related Art

Among high-strength low ductility fibers, carbon fibers have characteristics such as light weight, high corrosion resistivity, non-magnetic property, high coefficient of thermal conductivity, ultralow coefficient of thermal expansion, high tensile strength, and high tension modulus. In order to make full use of such characteristics, a fiber composite twisted cable having carbon fibers and thermosetting resin as a matrix combined to each other is known.

The fiber composite twisted cable is manufactured generally by forming strands by twisting bundles of carbon fibers impregnated with thermosetting resin, twisting a plurality of such strands, and then curing the thermosetting resin by heat treatment.

However, there is a problem such that air or residual solvent contained in thermosetting resin remains in the interior of a cable as gaps between a process of impregnating with the thermosetting resin and a process of forming a cable by twisting the plurality of strands, whereby mechanical characteristics such as the tensile strength per cross-sectional area of the cable, which is important characteristics as the fiber composite twisted cable is lowered.

Accordingly, in JP-A-2-127583, a fiber composite twisted cable formed by winding a fiber yarn on an outer periphery of a strand impregnated with thermosetting resin at an angle close to a right angle with respect to the axial direction of the strand in high density, then twisting a plurality of the strands, and then curing the thermosetting resin by heat treatment is proposed.

According to the related art, the fiber bundles are prevented from being unlaid by winding the fiber yarn, and an effect of expelling the air or the residual solvent contained in the interior of the cable is expected by a winding pressure of the fiber yarn. However, when twisting the plurality of strands impregnated with the thermosetting resin, liquid-state thermosetting resin in an uncured state is squeezed out from between the wound fiber yarns, so that the resins from adjacent side strands moisten with respect to each other, and flows into a gap between a core strand and the side strands and stays therein.

Therefore, when the thermosetting resin is cured in a last process, the adjacent strands are adhered and integrated with each other (the core strand and the side strands, and the side strands and the side strands), so that the entire cable becomes cured like a hard rod.

Therefore, bending rigidity of the fiber composite twisted cables in the related art is very high and, consequently, flexibility that the cable should have under normal circumstances by having a twisted wire structure is impaired, and hence a large reel provided with a large-diameter winding barrel is required.

Consequently, when applying the fiber composite twisted cable to a reinforcing member for an overhead transmission line and performing a wiring work in a mountain range for example, problems in transport such that a large vehicle for loading the large reel is required and, road works for moving the large vehicle in turn are required are inevitable.

Furthermore, when winding the fiber composite twisted cable on the reel, partial separation of the thermosetting resin which bonds the strands with respect to each other occurs by bending, so that bonded portions and separated portions exist together between the adjacent strands in the longitudinal direction of the cable. Consequently, there arises a problem such that bending occurs when the cable is withdrawn from the reel when using the cable and hence linearity of the cable is impaired.

SUMMARY OF THE INVENTION

In order to solve the above-described problems as described above, the fiber composite twisted table in the related art is improved, and it is an object of the invention to provide a fiber composite twisted cable having preferable flexibility and being superior in transportability and workability suitable for being used as a reinforcing member for a high-voltage transmission line or a tensile strength reinforcing member for concrete structures such as a bridge girder.

In order to achieve the above described object, a fiber composite twisted cable according to an embodiment of the invention is a cable having 1×n structure which is formed by impregnating bundles of carbon fibers with thermosetting resin, then twisting a plurality of strands each formed by covering an outer periphery of the bundle with a fiber, and then curing the thermosetting resin by heat treatment, and is characterized in that a core strand and side strands surrounding the same, which constitute the 1×n structure, are in contact with each other separately and independently without being bonded to each other so as to allow the respective strands to perform independent behaviors when the cable is bent at a right angle with respect to the longitudinal direction.

With the fiber composite twisted cable according to the invention, the respective strands which constitute the cable are separately and independently in contact with each other without being bonded to each other, and minute gaps for allowing the independent behaviors when the cable is bent in the direction at a right angle with respect to the longitudinal direction thereof are formed between the core strand and the side strands surrounding the same. Therefore, a constraining force is suitably alleviated by a slipping effect between the adjacent strands, whereby the flexibility required for the cable is improved.

Since deformation of the strands due to a bending stress applied to the cable is facilitated by the gaps surrounded by the side strands and the core strand secured therein, the flexibility is further improved.

Therefore, according to the embodiment of the invention, since the flexibility of the cable is improved, winding of the cable around the reel, which is inevitable when manufacturing a long cable or transporting the cable as a product, can be performed without problem, and the barrel diameter of the reel can also be reduced.

Therefore, when it is used as the reinforcing member for the high-voltage transmission line or the tensile strength reinforcing member for the concrete structure such as a bridge girder, transport of the cable to the mountain range or the mountain area is facilitated, and a transport cost can be reduced.

Since the cable can be wound around the reel without problem, generation of abnormal residual stress on the cable is avoided, and formation of curl is avoided even when the cable is withdrawn from the reel when using the same. The cable withdrawn from the reel is easy to handle, allows measurement of the cable length with high degree of accuracy on site, and allows easy terminal process. Therefore, the workability is improved.

BRIEF DESCRIPTION OF THE DRAWINGS

FIG. 1A is a perspective view showing a first embodiment of a fiber composite twisted cable according to the invention;

FIG. 1B is a vertical cross-sectional front view of the first embodiment;

FIG. 1C is a partial enlarged view of FIG. 1B;

FIG. 2A is a perspective view showing a state in which the fiber composite twisted cable according to the first embodiment is about to be put asunder;

FIG. 2B is a perspective view of the fiber composite twisted cable shown in FIG. 2A after having put asunder;

FIG. 7A is a perspective view showing a fiber composite twisted cable after having finished the heat treatment;

FIG. 7B is a cross-sectional view of the fiber composite twisted cable after having finished the heat treatment;

FIG. 7C is a partial enlarged view of FIG. 7B;

FIG. 8A is a side view showing an apparatus and a process of separating the strands of the fiber composite twisted cable;

FIG. 8B is a cross-sectional view taken along the line X-X in FIG. 8A;

FIG. 9A is a perspective view showing a second embodiment of a fiber composite twisted cable according to the invention;

FIG. 9B is a cross-sectional view showing a state before strand separation according to the second embodiment;

FIG. 10A is a perspective view showing a third embodiment of a fiber composite twisted cable according to the invention;

FIG. 10B is a cross-sectional view showing a state before strand separation according to the third embodiment;

FIG. 11A is a drawing of a state in which power cables are strung showing an example in which the fiber composite twisted cable according to the embodiment of the invention is applied to a reinforcing member of the a high-voltage transmission line;

FIG. 11B is a partially cut-out side view of the power cable shown in FIG. 11A;

FIG. 11C is a cross-sectional view of the power cable shown in FIG. 11B;

FIG. 12A is a perspective view of a bottom of a bridge showing an example in which the fiber composite twisted cables according to the embodiment of the invention are applied to tensile strength reinforcing members of a concrete bridge girder; and FIG. 12B is a bottom view of the bridge girder in a tensed state.

DETAILED DESCRIPTION OF THE INVENTION

Figure 3:
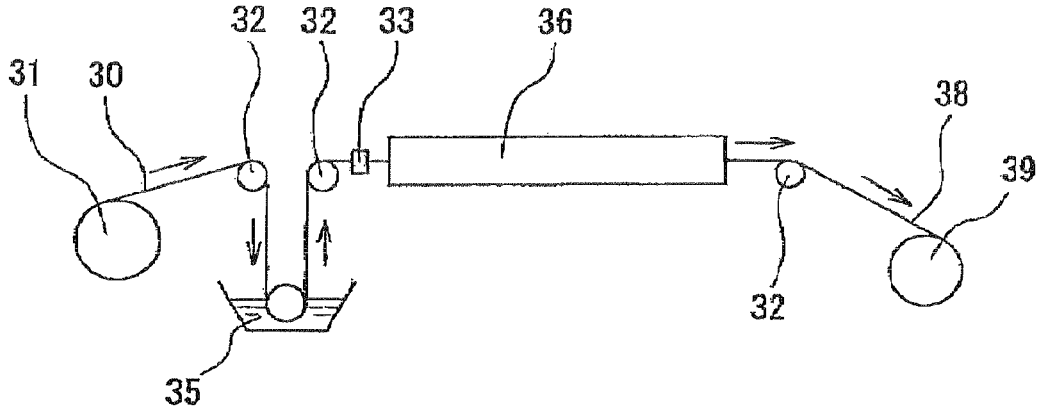
FIG. 3 is an explanatory drawing showing a process of manufacturing a prepreg by impregnating a multifilament formed of carbon fibers with thermosetting resin.

Referring now to the attached drawings, an embodiment of the present invention will be described.

FIG. 1A to FIG. 2B show a fiber composite twisted cable having 1×7 structure according to an embodiment of the invention. Reference numeral 1 designates an entire fiber composite twisted cable (hereinafter, referred to simply as "cable"), having a diameter of 12 mm, for example. Reference numerals 21, 22 are strands which constitute the cable 1. The cable 1 includes seven strands having the same thickness. Six side strands 22 are arranged around a single core strand 21, and these strands are twisted together.

The core strand 21 and the side strands 22 are formed by binding or twisting a plurality of prepregs 2', which are formed by impregnating respective bundles of PAN (polyacrylonitrile) carbon fibers 2 with thermosetting resin 3 as shown in FIG. 1C. Also, the outer periphery of the each strand is covered with a fiber yarn 4 wound therearound at an angle close to a right angle with respect to the axial direction of the strand in the high density. The "yarn" here is a concept including a tape.

The core strand 21 and the six side strands 22 are covered with the fibers, and are twisted with the thermosetting resin contained therein uncured and hence are formed into the uncured fiber composite twisted cable. Then, the uncured fiber composite twisted cable is subjected to heat treatment so that the thermosetting resin is cured.

However, in the embodiment of the invention, the adjacent side strands 22 and 22 are not bonded to each other, and the side strands 22 and the core strand 21 are not bonded to each other, that is, the respective strands are separated and independent and are only in contact with each other in the longitudinal direction.

Therefore, five gaps 5 in substantially a triangle shape, where the thermosetting resin is not present, are formed in a portion surrounded by the core strand 21 and the two side strands 22 and 22 in the embodiment as shown in FIG. 1B, and the gaps 5 function as spaces for allowing independent behaviors of the strands when the cable is bent in the direction at a right angle with respect to the longitudinal direction.

FIGS. 2A and 2B show the fiber composite twisted cable being put asunder. The single core strand 21 at the center and the six side strands 22 positioned therearound exist separately and independently respectively at a regular helical pitch. The separate and independent relationship between the core strand 21 an the side strands 22 is realized by performing a separation process which forcedly releases a bonded state of the respective strands after the heat treatment, that is, after having cured the thermosetting resin.

More specifically, in a manufacturing process, the core strand 21 and the six side strands 22 are twisted in the state in which the thermosetting resin contained therein is uncured or semi-cured. The thermosetting resin is extruded out from between the fiber yarns 4 on the outer peripheries of the respective strands by a pressure applied by this twisting action, and wets the adjacent side strands 22 with respect to each other. It also wets the periphery of the core strand 21, so that the gaps around the side strands 22 and the core strand 21 are filled with the thermosetting resin. In this state, heat is applied and the thermosetting resin is cured, so that the adjacent side strands 22 and 22 are integrally bonded to each other and the side strands 22 and 22 and the core strand 21 are also bonded to each other.

Normally, the fiber composite twisted cable is considered to be a finished product in the state described above. However, according to the embodiment of the invention, the integrally bonded side strands 22 and 22, and the side strands 22 and 22 and the core strand 21 are separated after the heat treatment into independent individual strands and, in this state, these strands are twisted again into the original state. The separating process is performed after the thermosetting resin is cured and stabilized. Therefore, the adjacent side strands 22 and 22 and the core strand 21 are never bonded to each other again.

Since the core strand 21 and the side strands 22 are separated and independent, when a bending stress is applied to the cable 1, the side strands 22 can be moved in their own about the core strand 21. Therefore, bending rigidity is smaller than that of a bar (rod) having the same diameter, so that higher flexibility is resulted.

Since the substantially triangle gap 5 per unit, which is surrounded by the core strand 21 and the two side strands 22 and 22 allow the side strands 22 to run off on the tensed side and the compressed side when being bent. Therefore, the cable 1 can easily be bent and the residual stress is also alleviated.

Subsequently, the manufacturing process of the fiber composite twisted cable 1 according to an embodiment of the invention will be described in detail.

FIG. 3 shows a process for obtaining the strand. A multifilament 30 including 12000 carbon fibers having a diameter of 7 μm, for example, and being aligned in parallel are wound around a reel 31. The multifilament 30 is withdrawn from the reel 31, is guided to a resin bath 35 via a guide roll 32, and is allowed to submerge through the thermosetting resin 3, for example, modified epoxy resin, stored therein, and the multifilament 30 is impregnated with the modified epoxy resin.

The multifilament 30 impregnated with the modified epoxy resin is introduced into a dice 33, and excessive modified epoxy resin is pressed and removed, and is formed into a circular shape in cross-section. Then, the multifilament 30 is passed through a drying furnace 36 to semi-cure the thermosetting resin to form a prepreg (element wire) 38, which is wound around a reel 39. The prepreg may be kept in uncured state by omitting or stopping operation of the drying furnace 36.

Subsequently, a number of, for example, fifteen prepregs 38 manufactured in the previous process, not shown, are bundled and twisted at a large pitch, for example, 90 mm, so that a composite element strand is obtained. In this process, for example, fifteen reels 39 having the prepreg 38 wound therearound are arranged on a stand, the fifteen prepregs are withdrawn and bundled into the composite element strand and are twisted by turning the reel in the direction at a right angle with respect to a movement path while winding the same together on a reel.

The modified epoxy resin is used when the heat resistance on the order of 130° is required. When the heat resistance as high as 240° is required, Bismaleimide resin is used.

Figure 4:
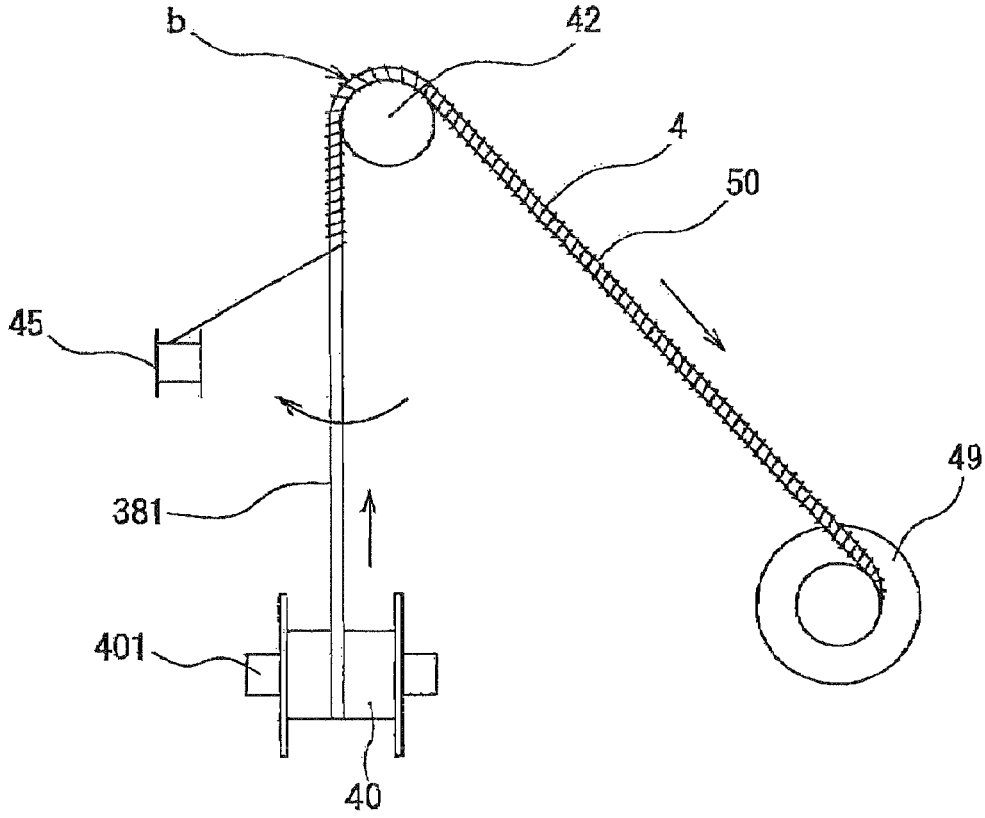
FIG. 4 is an explanatory drawing showing a process of manufacturing a covered composite strand.

FIG. 4 shows a formation of the strand and a covering process, in which reference sign b designates a covering device. A reel 40 having a composite element strand 381 manufactured in the previous process wound therearound is mounted on a supporting shaft 401 of the covering device b.

The covering device b is provided with a winding machine 45 around the movement path of the composite element strand, and the fiber yarn 4 is wound around the winding machine 45. Multifilament yarn formed of multipurpose fiber such as polyester fiber is suitable as the fiber yarn and, for example, that having 8 yarns of 1000 denier is exemplified.

The composite element strand 381 is wound by a strand reel 49 via a guide roll 42, and the winding machine 45 is turned around the composite element strand 381 in the course of movement to wind the fiber yarn 4 on an outer periphery of the composite element strand 381 to cover the outer periphery at an angle close to a right angle with respect to the axial direction, for example, at 60 to 85 degrees in the high density. Consequently, a covered composite strand 50 is manufactured.

The purpose for covering the periphery of the strand with the fiber is to bundle the composite element strand 381 and prevent the same from being deformed or unlaid at the time of twisting. Another purpose is to discharge and remove the excessive thermosetting resin or solvent which the strands are impregnated with, or air bubbles which may cause the strength of the cable to be lowered or the like by a winding pressure.

Figure 5:
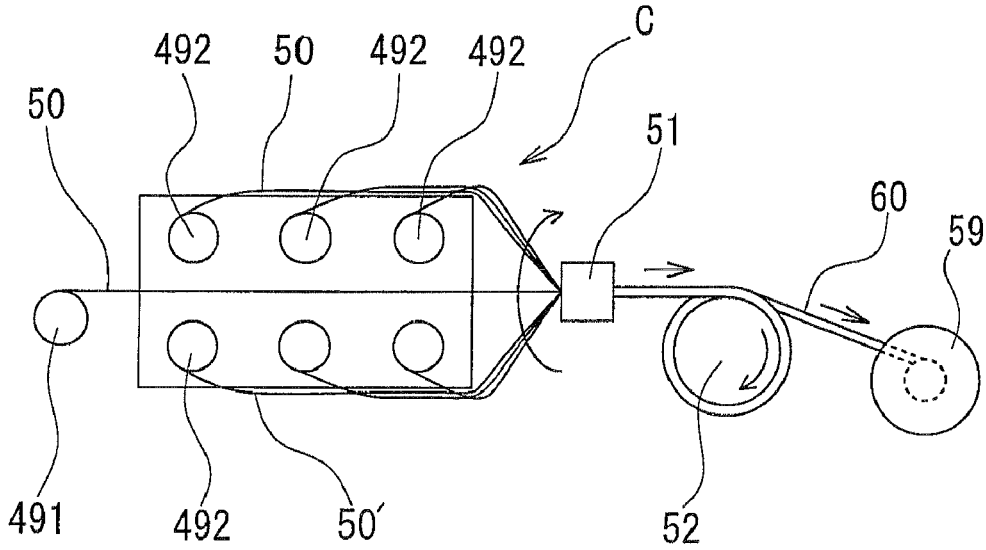
FIG. 5 is an explanatory drawing showing a process of manufacturing a composite twisted cable in a semi-cured or uncured state by twisting the covered composite strands.

Subsequently, the seven strand reels on which the covered composite strands 50 are wound are mounted on a twisting device c shown in FIG. 5.

The twisting device c includes one strand reel 491 on which a strand which becomes the core strand is wound, and six strand reels 492 on which strands which become the side strands arranged therearound. The six strand reels 492 for the side strands are rotated around the single composite strand 50 which becomes the core strand, the six covered composite strands 50' which become the side strands are twisted and are passed through a voice 51 while being pulled by a capstan 52, so that the thermosetting resin is wound around a reel 59 as a composite twisted cable 60 in the state in which the thermosetting resin is semi-cured or uncured.

Figure 6:
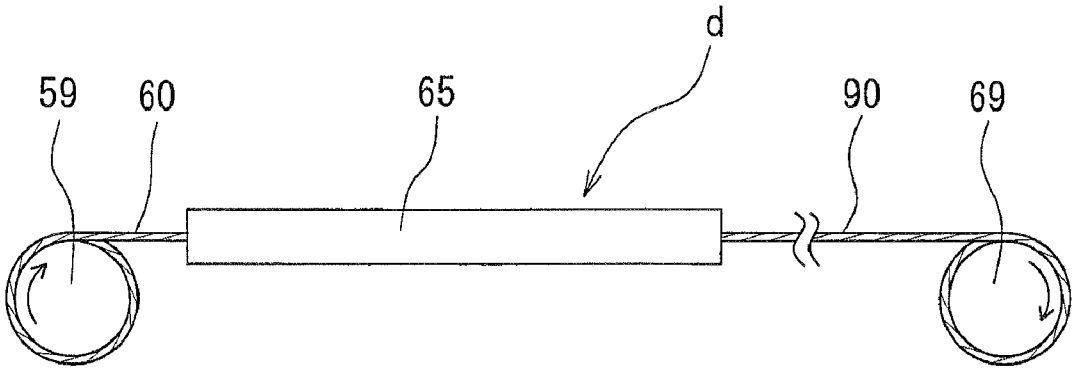
FIG. 6 is an explanatory drawing showing a heat treatment process.

Subsequently, the reel 59 on which the uncured composite twisted cable 60 is wound is arranged in a heat treatment device d shown in FIG. 6, and the uncured composite twisted cable 60 is passed through a heater 65 under the conditions of, for example, 130° C. and 90 minutes, the semi-cured or uncured thermosetting resin is completely cured, and a cured composite twisted cable 90 is wound around a reel 69.

A semi-cured or uncured thermosetting resin 300 contained in the composite strand of the cured composite twisted cable 90 is exuded from the gaps between the fiber yarns in the initial stage of heating. The respective gaps surrounded by a core strand 91 and side strands 92, 92 is filled with the exuded thermosetting resin 300 and the thermosetting resin 300 filled in the respective gaps is cured in the latter half of the heating period. Therefore, as shown in FIG. 7A to FIG. 7C, the core strand 91 and the side strands 92 are integrally bonded. Since the troughs between the adjacent side strands 92, 92 are also filled with the thermosetting resin 300, the side strands 92, 92 are also bonded to each other.

The form as described above is unavoidable in the fiber composite twisted cable in the related art. The inventors thought of applying the heat treatment on the composite strands 50, 50' manufactured in the process shown in FIG. 4, forming the strands whose thermosetting resin contained therein is cured, and twisting these hard covered strands into a cable as a measure for improving the flexibility. However, since the hard covered strands are already in the state of hard rods, it is very difficult to bundle seven such hard strands and twist the same into the helical shape. In addition, since the thermosetting resin in the strands is separated during twisting and hence the function as the matrix is impaired, it is not suitable.

Accordingly, in the invention, the core strand 91 and the side strands 92, which are bonded and cured with the thermosetting resin exuded into the gaps surrounded by the core strand 91 and the side strands 92, 92 are separated (unstuck) from each other using specific means and process. The bonding between the side strands 92 is also separated (unstuck) from each other.

FIG. 8A and FIG. 8B show the process and the device therefor. A strand separating device e includes a rotatable separation plate 70, and a separation voice 75 and the binding voice 76 are positioned on the downstream side and the upstream side of the separation plate 70, respectively. The separation plate 70 is formed of a circular metallic plate and includes a core strand insertion hole 73 for insertion of the core strand 91 of the cured composite twisted cable 90 at the center thereof and a plurality of side strand insertion holes 74 arranged radially from the core strand insertion hole 73 apart from each other uniformly. In this example, there are provided the six side strand insertion holes 74.

The separation of the core strand 91 and the side strands 92 are performed as follows. In other words, the cured composite twisted cable 90 wound around the reel 69 is inserted through the separation voice 75, a terminal end of the inserted cured composite twisted cable 90 is unlaid into individual strands. The core strand 91 is inserted through the core strand insertion hole 73 of the separation plate 70, and the six side strands 92 are inserted respectively through the side strand insertion holes 74.

Then, the strands 91 and 92 passed through the separation plate 70 are introduced into the binding voice 76, and are guided to a reel 80 via a capstan 79. At this time, the separation plate 70 is rotated in the direction opposite from the direction of twisting of the cured composite twisted cable 90 in conjunction with a speed of pulling out the cured composite twisted cable 90.

With this process, the core strand 91 and the side strands 92 of the cured composite twisted cable 90 are separated and the side strands are separated from each other, and hence the bonded state is released. Therefore, the unstuck independent strands are restored to "1×7" twisted relationship in the binding voice 76, and hence is withdrawn as the fiber composite twisted cable 1 according to the embodiment of the invention in FIG. 1 and is wound around the reel 80.

The fiber composite twisted cable 1 is improved in flexibility because the gaps, which allow the independent behaviors of the respective strands 21, 22 when the cable is bent, are formed between the core strand 21 and the side strands 22 surrounding the same, which constitute the cable, as shown in FIG. 1 and FIG. 2, so that the reel 80 may be downsized in diameter of the barrel and the flange in comparison with the reel for winding the cured fiber composite twisted cable 90 in the related art. Therefore, the style of packaging is downsized and the weight is reduced, so that easy transport is achieved.

Referring now to the attached drawings, a second embodiment of the invention will be described.

FIG. 9A shows a fiber composite twisted cable 100 having a structure of 1×19 including nineteen strands, and having a diameter of 18 mm according to the second embodiment of the invention. The composite twisted cable 100 is configured as described in the first embodiment, and the strands are separated and independent without being bonded to each other so that gaps for allowing independent behaviors of the respective strands when the cable is bent are formed between a core strand and side strands surrounding the same.

The composite twisted cable 100 includes a single core strand 111 and six first layer strands 112 twisted so as to surround the core strand 111, and also includes twelve second layer strands 113 twisted on an outer periphery thereof.

The respective strands 111, 112 and 113 have a configuration including a plurality of twisted prepregs, which are formed of bundles of PAN carbon fiber impregnated with thermosetting resin as in the first embodiment, and outer peripheries of the strands are covered with a fiber yarn 400 wound therearound at an angle close to a right angle with respect to the axial direction of the strand in the high density.

Reference numerals 500 designate five substantially triangle shaped gaps surrounded by the core strand 111 and the first layer strands 112 and 112. By the existence of the gaps, the first layer strands 112 and 112, and the core strand 111 are separated and independent and are only in contact with each other in the longitudinal direction without being bonded to each other. The adjacent first layer strands 112 and 112 are also separated and independent in the longitudinal direction without being bonded to each other.

Reference numerals 501 designate six substantially crescent-shaped gaps surrounded by the first layer strands 112 and the second layer strands 113, and the first layer strands 112 and the second layer strands 113 are separated and independent and are only in contact with each other in the longitudinal direction without being bonded to each other. The adjacent second layer strands 113 and 113 are also separated and independent and are only in contact with each other in the longitudinal direction without being bonded to each other.

The gaps 500, 501 function as spaces which allow independent behaviors of the strands when the cable is bent in the direction at a right angle with respect to the longitudinal direction of the cable.

The manufacturing process will be described, the core strand 111, the first layer strands 112, and the second layer strands 113 after having covered with the fiber yarns are twisted into an uncured fiber composite twisted cable in a state in which the thermosetting resin contained therein is not cured, and the thermosetting resin is cured by applying the heat treatment on the uncured fiber composite twisted cable, whereby a semi-finished product as shown in FIG. 9B is obtained. At this time, as in the case of the first embodiment, the core strand 111 and the first layer strands 112 are integrally bonded with the exuded liquid-state thermosetting resin 300, and the first layer strands 112 and the second layer strands 113 surrounding the same are integrally bonded with the exuded liquid-state thermosetting resin 300.

In order to obtain the above-described composite twisted cable 100, as in the case of the first embodiment, it is forcedly unstuck using a separating device to release the bonded state. Other points are the same as described in the first embodiment.

Referring now to the attached drawings, a third embodiment of the invention will be described.

FIG. 10A shows a fiber composite twisted cable 200 having a structure of 1×37 including thirty seven strands, and having a diameter of 28 mm according to a third embodiment of the invention.

The cable 200 includes a single core strand 211 and six first layer strands 212 twisted so as to surround the core strand 211, includes twelve second layer strands 213 twisted on an outer periphery thereof, and further includes eighteen third layer strands 214 twisted on the outer periphery thereof.

Reference numerals 500 designate five substantially triangle shaped gaps surrounded by the core strand 211 and the first layer strands 212 and 212. By the existence of the gaps, the first layer strands 212 and 212, and the core strand 211 are separated and independent and are only in contact with each other in the longitudinal direction without being bonded to each other.

Reference numerals 501 designate six substantially crescent-shaped gaps surrounded by the first layer strands 212 and the second layer strands 213, and the first layer strands 212 and the second layer strands 213 are separated and independent and are only in contact with each other in the longitudinal direction without being bonded to each other. The adjacent second layer strands 213 and 213 are also separated and independent without being bonded to each other and are in contact with each other in the longitudinal direction.

Reference numerals 502 designate a number of diamond-shaped gaps surrounded by the second layer strands 213 and the third layer strands 214. With these gaps, the second layer strands 213 and the third layer strands 214 are separated and independent and are in contact with each other in the longitudinal direction without being bonded to each other. The adjacent third layer strands 214 and 214 are also separated and independent without being bonded to each other and are in contact with each other in the longitudinal direction. The gaps 500, 501 and 502 function as spaces which allow independent behaviors of the strands when the cable is bent in the direction at a right angle with respect to the longitudinal direction of the cable.

The core strand 211, the first layer strands 212, the second layer strands 213 and the third strands 214 after having covered with the fiber yarns are twisted into an uncured fiber composite twisted cable in a state in which the thermosetting resin contained therein is not cured, and the thermosetting resin is cured by applying the heat treatment on the uncured fiber composite twisted cable, whereby a semi-finished product as shown in FIG. 10B is obtained. At this time, as in the case of the first embodiment, the core strand 211 and the first layer strands 212 are integrally bonded with the exuded liquid-state thermosetting resin 300, and the first layer strands 212 and the second layer strands 213 surrounding the same, and the second layer strands 213 and the third layer strands 214 surrounding the same are integrally bonded with the exuded liquid-state thermosetting resin 300.

In order to obtain the above-described composite twisted cable 200, as in the first embodiment described above, it is forcedly unstuck using the separating device to release the bonded state of the strands with respect to each other. Other points are the same as described in first embodiment.

FIGS. 11A, 11B and 11C show examples in which the fiber composite twisted cable according to the embodiment of the invention is used as a reinforcing member for an overhead transmission line. High-voltage transmission lines B extended between steel towers A in FIG. 11A have a structure as shown in FIG. 11B and FIG. 11C. In other words, the fiber composite twisted cable 1 in the first embodiment is used as a core member, and aluminum lines or heat-proof aluminum alloy wires 900 are arranged in two layers and twisted on the periphery thereof.

FIGS. 12A and 12B show examples in which the fiber composite twisted cable according to the embodiment of the invention is applied to a reinforcing member of a concrete structure. In order to reinforce a bridge girder C, the fiber composite twisted cables 1, 100, or 200 according to any one of the first to the third embodiments are extended between the bridge girders C provided at both ends in the longitudinal direction, and a tonicity is applied thereto using a fixing member.

The fiber composite twisted cable according to the embodiments of the invention is applied also to cables for a suspension bridge or ground anchors.

What is claimed is:

1. A fiber composite twisted cable having 1×n structure which is formed by impregnating bundles of carbon fibers with thermosetting resin, then twisting a plurality of strands each formed by covering an outer periphery of the bundle with a fiber, and then curing the thermosetting resin by heat treatment, wherein an unstuck process is applied, wherein said unstuck process is a process to forcedly separate the respective strands of the twisted cable having the thermosetting resin cured and forcedly release a bonded state of the strands, such that each of a core strand and side strands surrounding the same, which constitute 1×n structure, is allowed to perform independent behaviors when the cable is bent in a direction orthogonal to its longitudinal direction.

2. The fiber composite twisted cable according to claim 1, wherein the structure is 1×7.

3. The fiber composite twisted cable according to claim 1, wherein the structure is 1×19.

4. The fiber composite twisted cable according to claim 1, wherein the structure is 1×37.

5. The fiber composite twisted cable according to claim 1, wherein the twisted cable is used as a reinforcing material for an overhead transmission line.

* * * * *